US008904832B1

(12) United States Patent
Rodriguez et al.

(10) Patent No.: US 8,904,832 B1
(45) Date of Patent: Dec. 9, 2014

(54) HANDCUFF

(71) Applicant: Mike Rodriguez, Big Timber, MT (US)

(72) Inventors: Mike Rodriguez, Big Timber, MT (US); Ross Walker, Bozeman, MT (US); David Yakos, Bozeman, MT (US); Stephen Sanford, Bozeman, MT (US)

(73) Assignee: Mike Rodriguez, Big Timber, MT (US)

( * ) Notice: Subject to any disclaimer, the term of this patent is extended or adjusted under 35 U.S.C. 154(b) by 0 days.

(21) Appl. No.: 13/969,795

(22) Filed: Aug. 19, 2013

(51) Int. Cl.
*E05B 75/00* (2006.01)

(52) U.S. Cl.
CPC ..... *E05B 75/00* (2013.01)
USPC ..... 70/16

(58) Field of Classification Search
CPC ..... E05B 75/00; E05B 75/005
USPC ..... 70/14–19; 24/16 PB; 119/816, 819; 128/878, 879
See application file for complete search history.

(56) References Cited

U.S. PATENT DOCUMENTS

| | | | | | |
|---|---|---|---|---|---|
| 636,439 | A | * | 11/1899 | Maltby | 70/17 |
| 686,626 | A | * | 11/1901 | Maltby | 70/16 |
| 691,941 | A | * | 1/1902 | Headson | 70/17 |
| 859,131 | A | * | 7/1907 | Snearly | 119/863 |
| 885,811 | A | * | 4/1908 | Ward | 70/17 |
| 1,014,118 | A | * | 1/1912 | Carberry | 70/16 |
| 1,116,329 | A | * | 11/1914 | Russell | 70/16 |
| 1,197,549 | A | * | 9/1916 | Russell | 70/17 |
| 2,516,878 | A | * | 8/1950 | Howe | 70/16 |
| 2,772,553 | A | * | 12/1956 | Howe | 70/16 |
| 2,948,139 | A | * | 8/1960 | Howe | 70/16 |
| 4,314,466 | A | | 2/1982 | Harris | |
| 4,509,346 | A | | 4/1985 | Szczepanek | |
| 4,697,441 | A | | 10/1987 | Allen | |
| 5,138,852 | A | | 8/1992 | Corcoran | |
| 5,463,884 | A | | 11/1995 | Woo et al. | |
| 5,555,751 | A | | 9/1996 | Strickland et al. | |
| 5,598,723 | A | | 2/1997 | Ecker et al. | |
| 5,660,064 | A | | 8/1997 | Ecker et al. | |
| 5,743,117 | A | | 4/1998 | Woo et al. | |
| 5,797,284 | A | | 8/1998 | Lurie | |
| 5,799,514 | A | | 9/1998 | Tobin, Jr. et al. | |
| 6,568,224 | B1 | | 5/2003 | Taper et al. | |

(Continued)

OTHER PUBLICATIONS

Photo of Handcuff Mechanism, www.flickr.com/photos/brink0x3f/7619986434, retrieved Nov. 18, 2013.

(Continued)

*Primary Examiner* — Lloyd Gall
(74) *Attorney, Agent, or Firm* — Husch Blackwell LLP

(57) ABSTRACT

A handcuff that includes two compression control mechanisms that allow the handcuff to ensure a tight fit, but prevent the handcuff from being over-tightened causing injury and preventing potential liability. The handcuff includes a first half bracelet and a second half bracelet that are pivotally coupled. The first half bracelet includes a base that houses a locking mechanism and the second half bracelet includes a toothed portion that operably engages the locking mechanism. The handcuff includes a first compression control mechanism proximate the first half bracelet and a second compression control mechanism proximate the second half bracelet. The first and second compression control mechanisms engage the locking mechanism and are operable to automatically change the locking mechanism from an active mode to a locked mode to ensure the proper closure of the handcuff, and prevent the handcuff from being over constricted.

7 Claims, 8 Drawing Sheets

(56) References Cited

U.S. PATENT DOCUMENTS

| | | | | |
|---|---|---|---|---|
| 6,588,240 | B2 | 7/2003 | Anderson | |
| 6,619,077 | B1 | 9/2003 | Robinson | |
| 6,684,666 | B1 | 2/2004 | Taper | |
| 6,886,375 | B2 | 5/2005 | Amo | |
| 6,978,644 | B1 | 12/2005 | Taper | |
| 7,007,518 | B1 | 3/2006 | Taper | |
| 7,007,519 | B2 | 3/2006 | Parsons | |
| 7,017,234 | B2 | 3/2006 | Anderson | |
| 7,062,943 | B2 | 6/2006 | Parsons et al. | |
| 7,065,990 | B2 | 6/2006 | Parsons et al. | |
| 7,117,697 | B2 | 10/2006 | Parsons et al. | |
| 7,124,607 | B2 | 10/2006 | Parsons et al. | |
| 7,171,829 | B2 | 2/2007 | Parsons et al. | |
| 7,251,964 | B2 | 8/2007 | Wade | |
| 7,316,135 | B2 | 1/2008 | Parsons | |
| 7,316,136 | B2 | 1/2008 | Parsons | |
| 7,316,137 | B2 | 1/2008 | Parsons | |
| 7,424,811 | B2 | 9/2008 | Ham et al. | |
| 8,336,345 | B2 * | 12/2012 | Burgoon | 70/16 |
| 8,365,558 | B2 * | 2/2013 | Garibaldi | 70/16 |
| 2012/0085135 | A1 | 4/2012 | Louden | |

OTHER PUBLICATIONS

Photo of Peerless 700 Cut Away and Smith & Wesson Dealer Sample, date unknown.

Ian McColl, Title: Handcuff Patents, 1997, publisher unknown, photo of cover only.

* cited by examiner

HANDCUFF

CROSS-REFERENCE TO RELATED APPLICATIONS

None.

BACKGROUND OF THE INVENTION

1. Field of the Invention

The present invention is in the field of handcuffs for law enforcement or personal restraint purposes.

2. Description of Related Art

Handcuffs are mainly used by law enforcement officials to restrain suspected offenders. Every year there are a number of excessive force claims brought against law enforcement agencies claiming that the law enforcement officer applied the handcuffs too tightly around a target's wrist. These excessive force claims cost law enforcement agencies substantial amounts in attorney's fees and, in some cases, civil damages. Current handcuffs have no mechanisms to ensure the handcuff is applied in a manner sufficient to prevent the target from escaping, but also prevents the handcuffs from being over tightened.

Thus, there is a need in the art for a handcuff that includes compression control mechanisms on both half-bracelets to prevent over-tightening of the handcuff when the handcuff is being put on a target, but also provides sufficient closure to ensure that the target cannot free itself.

SUMMARY OF THE INVENTION

The present application is directed toward a handcuff that includes two compression control mechanisms which allow the handcuff to ensure a tight fit, but prevent the handcuff from being over-tightened causing injury and potential liability. The present handcuff includes a first half bracelet having a first end and a second end. The base of the handcuff is included at the second end of the first half bracelet and defines a housing that contains a locking mechanism. The present handcuff also includes a second half bracelet that has a first end and a second end. The first end of the second half bracelet is pivotally coupled to the first end of the first half bracelet. The second end of the second half-bracelet includes a toothed portion that engages the locking mechanism. Both the first and second half bracelets may have a curved shape wherein both curved shapes are orientated outwardly to define an enclosed area. As first and second half bracelets are moved relative to each other in a constriction direction, the enclosed area defined by the first and second half bracelet is reduced.

The present handcuff may also include a first compression control mechanism positioned proximate the first half bracelet and a second compression control mechanism positioned proximate the second half bracelet. The first and second compression control mechanisms engage the locking mechanism. The locking mechanism may operate in three modes: an active mode, a locked mode, and a release mode. While in an active mode, the locking mechanism interacts with the tooth portion to allow the second half bracelet to be displaced relative to the first half bracelet only in the constricting direction which reduce the enclosed area. In the active mode, the locking mechanism prevents the second half bracelet from reversing direction to increase the enclosed area. The active mode described is desirable in a handcuff as a struggling target cannot throw off the handcuff and, all the law enforcement officer needs to do is work to tighten the handcuffs.

The locked mode is entered by triggering both the first and second compression control mechanisms. In locked mode, the locking mechanism prevents any relative displacement of first and second half bracelets thereby preventing the handcuff from both loosening and tightening. The first and second compression control mechanisms may be activated by engaging the object being enclosed by the present handcuff (typically an arm or wrist). As the first and second half bracelets are being constricted around the object, the object engages the compression control mechanism that may be disposed proximate each half bracelet. Once sufficient displacement of the levers has occurred, the first and second compression control mechanisms cause a change in the orientation of the locking mechanism which prevents second half bracelet from being displaced relative to first half bracelet in any direction. The locked mode only occurs when the present handcuff is closed on the object with sufficient compression, and once the sufficient compression is reached, the locking mechanism prevents the present handcuff from being further constricted around the object.

The release mode disengages the locking mechanism and the toothed portion of second half bracelet thereby allowing second half bracelet to be moved in a direction that increases the enclosed area ultimately disengaging first and second half bracelets. The release mode allows the removal of the present handcuff from the object being enclosed. A handcuff key may be utilized by an operator to set locking mechanism in either the active and release modes.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
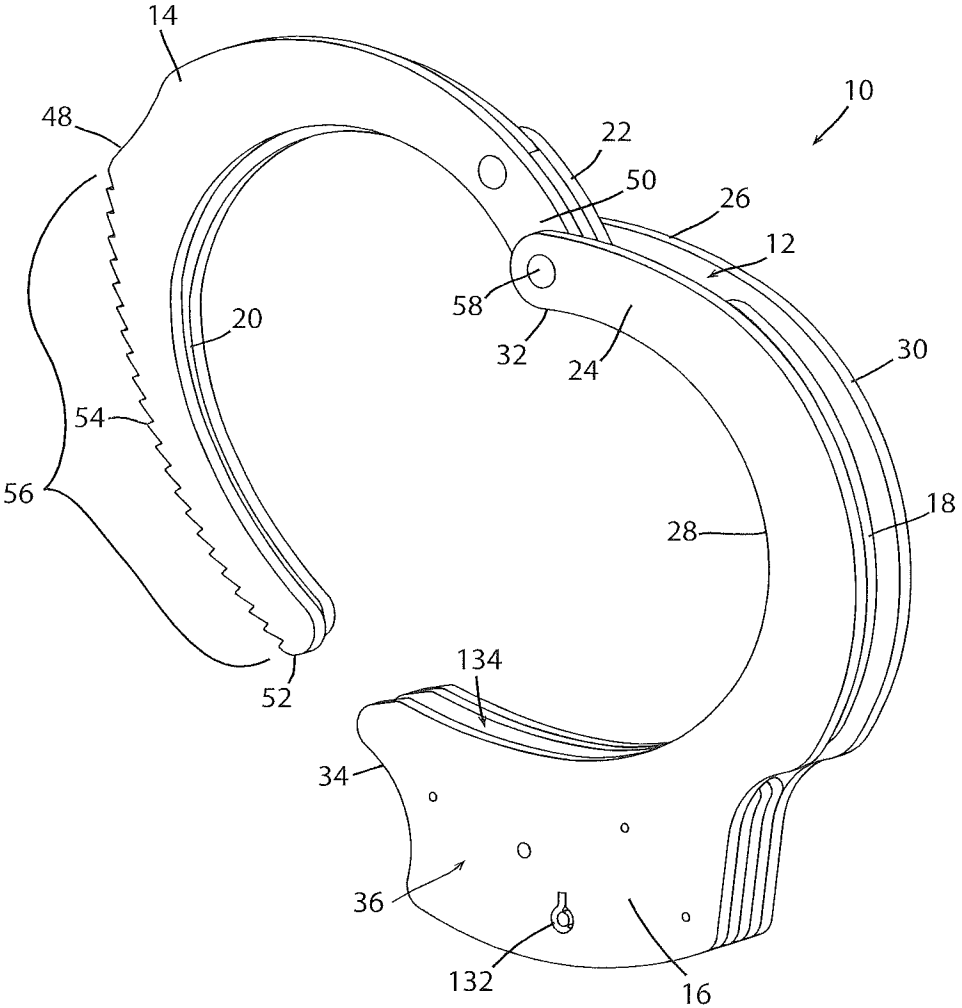
FIG. 1 is a perspective view of one embodiment of a handcuff in accordance with the teachings of the present invention.

FIG. 1 illustrates one embodiment of a handcuff 10 wherein handcuff 10 includes a first half bracelet 12, a second half bracelet 14, and a locking mechanism 16. Further, handcuff 10 includes a first closure compression control lever 18 and a second closure compression control mechanism 20 which are mechanisms that are operable to prevent handcuff 10 from being tightened too much when closed around a person's wrist. Handcuff 10 also includes a link member 22 that may assist in operably connecting second compression control mechanism 20 to second half bracelet 14.

Figure 2:
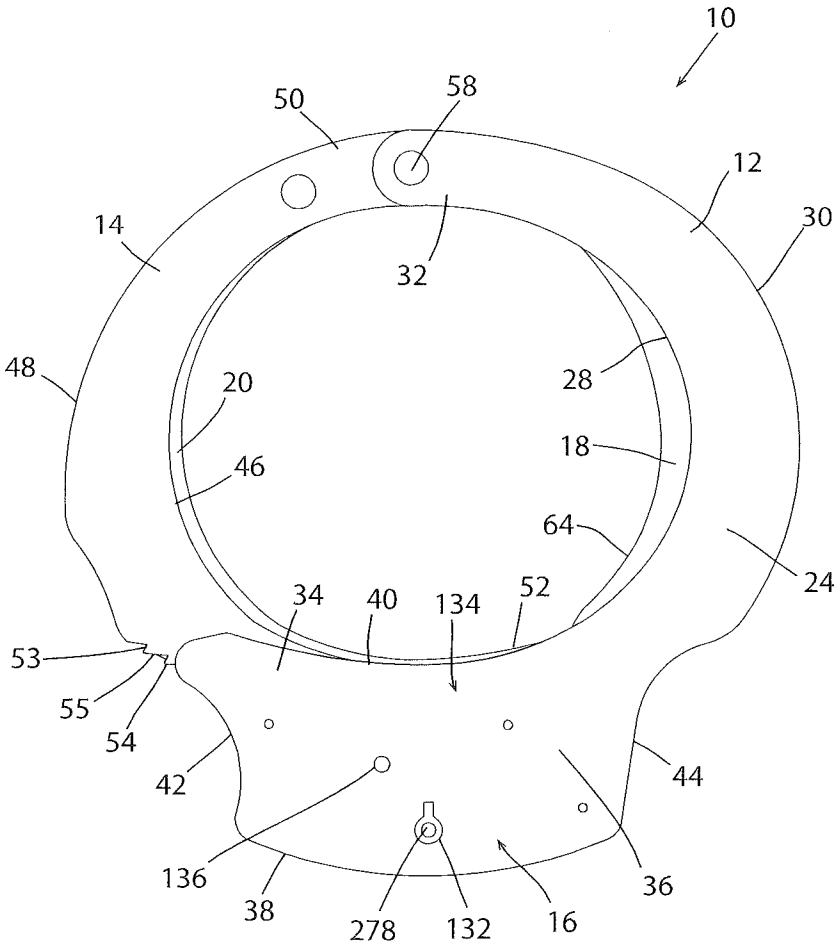
FIG. 2 is a front view of the embodiment of the handcuff of FIG. 1.

As further shown in FIG. 1, first half bracelet 12 comprises a first plate member 24 and a second plate member 26. As shown in FIGS. 1 and 2, first half bracelet 12 also includes an inner side 28, and an outer side 30. As shown, inner side 28 and outer side 30 may define a curved boundary. FIG. 2 shows first half bracelet further including a first end 32, a second end 34, and an outward extending base 36 integral in second end 34. Base 36 includes a bottom 38, a top 40, a first side 42 and a second side 44.

FIG. 2 also shows second half bracelet 14 having an inner side 46, an outer face 48, a first end 50 and a second end 52. Second half bracelet 14 may have a curved shape as shown. FIGS. 1 and 2 show second half bracelet 14 having a plurality of outwardly extending teeth 54 wherein the teeth have one short side 53 and one longer side 55 which intersect at an angle to form tooth 54. As shown in FIG. 1, second half bracelet includes a toothed portion 56 of outer face 48 proximate second end 52. As shown in FIGS. 1 and 2, first end 50 of second half bracelet 14 is pivotally coupled to first end 32 of first half bracelet 12 by a first pin 58 and FIG. 2 shows that when handcuff 10 is closed, first half bracelet 12 and second half bracelet 14 define an enclosed area that is sized to enclose an object, typically a portion of a person's arm proximate their hands, at or near the wrist.

Figure 3:
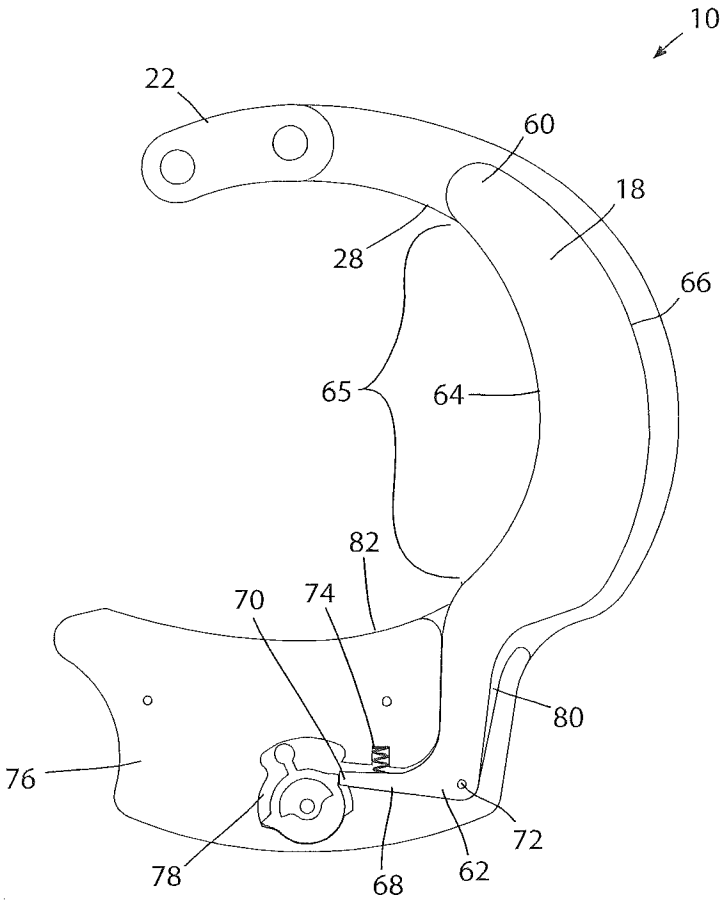
FIG. 3 is a front view of a partial construction of the embodiment, of the handcuff of FIG. 1.

FIG. 1 illustrates that first compression control lever 18 may be positioned between first plate member 24 and second plate member 26 and included in first half bracelet 12. Now turning to FIG. 3, first compression control lever 18 is shown having a free end 60, a pivot end 62, an inner face 64, and an outer face 66. Inner face 64 and outer face 66 may be curved outwardly as shown, particularly at an object engagement portion 65. Inner face 64 and outer face 66 may be concentric curves or may be any curved configuration at the discretion of the designer.

Compression control lever 18 includes a lock release leg 68 extending off of the pivot end 62 toward a middle of base 36. Lock release leg 68 includes a release end 70 that engages locking mechanism 16 as explained in more detail below. Compression control lever 18 is pivotally mounted between first plate member 24 and second plate member 26 by pin 72. Pin 72 may span between and may be coupled to first plate member 24 and second plate member 26 wherein an outward movement of the engagement portion 65 of first compression control lever 18 causes an upward movement of release end 70. Spring 74 is disposed in a first spacing member 76 and in engagement with lock release leg 68. Spring 74 resists outward movement of object engagement portion 65 of first compression control lever 18 and is operable to return lock release leg 68 to a neutral position. Spring 74 may, alternatively, be disposed along the length of compression control lever 18 to provide the resistance in the same direction. A person of skill in the art will appreciate that the lengths and relative orientations of the first compression control lever 18 and the lock release leg 68 will determine the vertical travel distance of release end 70.

First spacing member 76 is positioned between first plate member 24 and second plate member 26 and is included in base 36 of first half bracelet 12. First spacing member 76 has defined therein a portion of a housing 78 that houses portions of locking mechanism 16 and a first lever channel 80 that allows for the rotational movement of first compression control lever 18. First spacing member 76 is in the same plane as first compression control lever 18. First spacing member 76 includes a first lever channel 80 that extends from an outer edge 82 of first spacing member 76 to housing 78 that allows first compression control lever 18 to be positioned within first lever channel 80 and has a shape that allows some rotational movement therein. Outer edge 82 has a similar shape as base 36 of first and second plate members 24 and 26.

Figure 4:
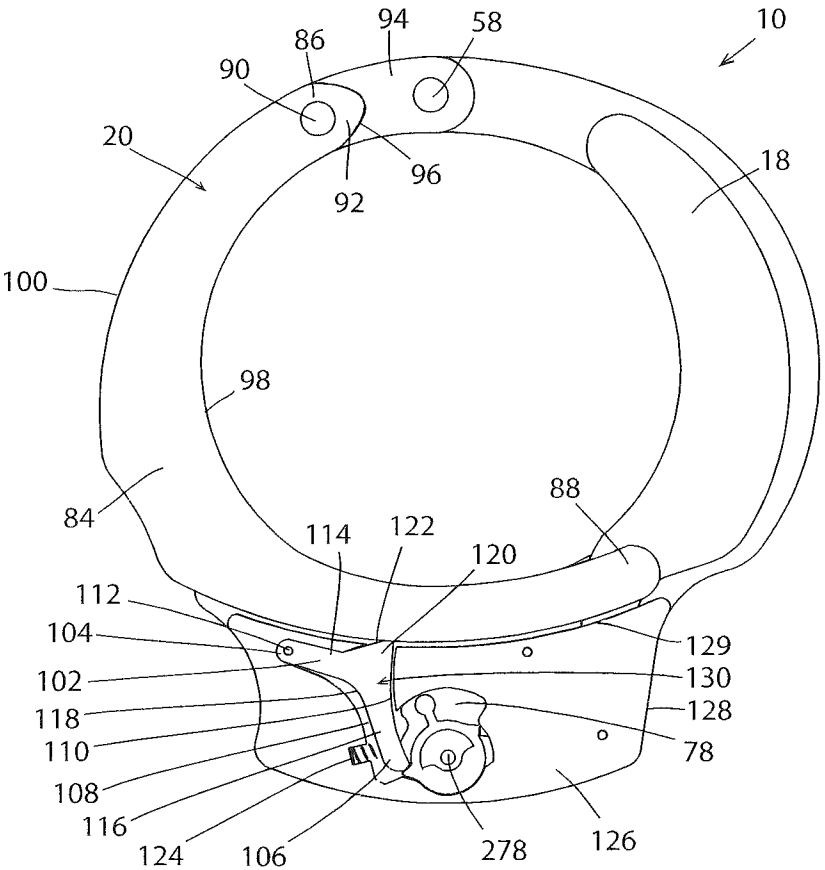
FIG. 4 is a front view of a partial construction of the embodiment of the handcuff of FIG. 1.

Now turning to FIG. 4, one embodiment of second compression control mechanism 20 comprises a lever 84 having a pinned end 86 and a free end 88, wherein lever 84 is pinned to second half bracelet 14 for rotational movement using second pin 90. Pinned end 86 may have a curved surface 92. As shown in FIG. 4, a link member 94 may be between first pin 58 and second pin 90 wherein link member 94 is secured at one end with first pin 58 and link member 94 may pivot about first pin 58. Further, link member 94 may include a concave end socket 96 proximate second pin 90 wherein curved surface 92 of pinned end 86 of lever 84 is received into concave end socket 96. Thus, the geometry of the curved surface 92 and the concave end socket 96 allows lever 84 to pivot about pin 90 within a limited rotational distance of travel independent of second half bracelet 14.

FIG. 4 further illustrates lever 84 having an inner face 98 and an outer face 100 wherein both inner face 98 and outer face 100 are outwardly curved. Inner face 98 and outer face 100 may be concentric or each may be curved at different radiuses. Lever 84 may have a substantially similar shape as second half bracelet 14. However, outer face 100 does not include any teeth.

FIG. 4 further shows the embodiment of second compression control mechanism 20 that includes a release lever 102 that includes a first end 104, a second end 106, a first side 108, and a second side 110. First end 104 of release lever 102 is secured to handcuff 10 by a pin 112 and release lever 102 may rotate about pin 112. As shown in FIG. 4, one embodiment of release lever 102 is substantially "L"-shaped with a first leg 114 and a second leg 116 extending from a bend 118 in release lever 102. Release lever 102 also includes a middle protrusion 120 extending outwardly that forms a portion of second side 110. Middle protrusion 120 includes an angled linear portion 122 of second side 110 as shown wherein the angled linear portion 122 extends upward and away from first end 104.

Second compression control mechanism 20 includes a spring 124 which provides resistance against the rotation of release lever 102 and keeps release lever 102 in a "neutral"

position when no force is exerted upon release lever 102 by lever 84. As shown in FIG. 4, spring 124 may engage a portion of first side 108 of second leg 116. However, spring 124 may be positioned anywhere with respect to release lever 102 to provide the described functionality. Spring 124 and all springs described herein are shown as a compression spring, but they may alternatively be a torsion spring, tension spring, or any other known spring.

As further shown in FIG. 4, a second spacing member 126 is positioned between first plate member 24 and second plate member 26 and is included in the base 36 of first half bracelet 10. Second spacing member 126 that is in the same plane as lever 84 and release lever 102. Second spacing member 126 comprises an outer edge 128 having the substantially same shape as base 36 and first spacing member 76, except a top side 129 of second spacing member may be recessed. Second spacing member 126 also includes a cut-out channel 130 that is shaped to receive release lever 102 and allow some rotational movement thereof within cut-out channel 130. Second spacing member 126 also defines a portion of housing 78.

Figure 5:
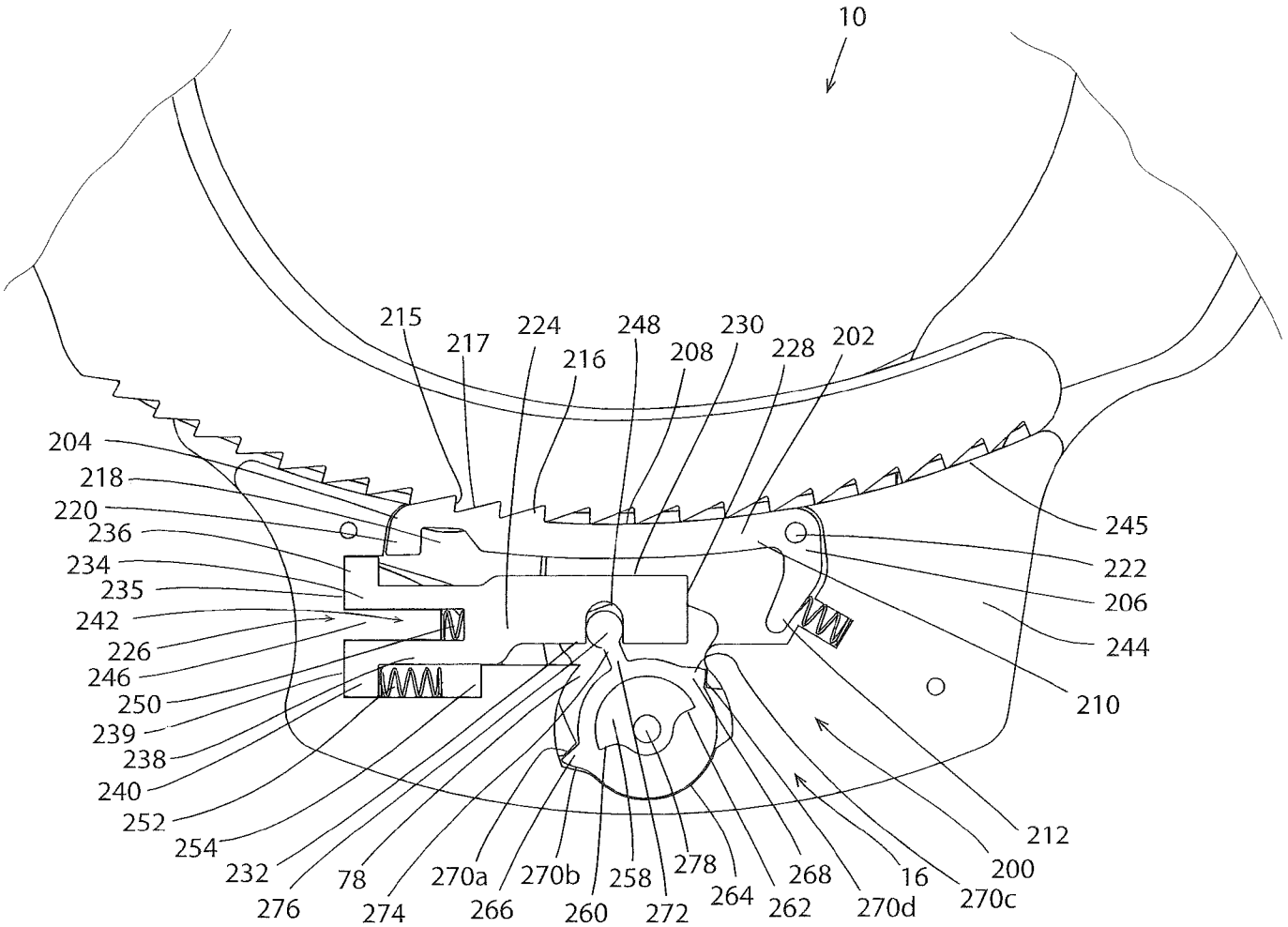
FIG. 5 is a partial front view of a partial construction of the embodiment of the handcuff of FIG. 1.

Handcuff 10 also includes locking mechanism 16 wherein one embodiment is lock assembly 200. As shown in FIG. 5, lock assembly 200 comprises a spring-biased ratchet arm 202, wherein spring-biased ratchet arm 202 includes a first end 204, a second end 206, a top side 208, and a bottom side 210. Spring-biased ratchet arm 202 includes a spring leg 212 extending in a substantially downward direction from bottom side 210. Spring leg 212 engages spring 214 wherein spring 214 is orientated in a substantially orthogonal direction to spring leg 212.

Spring-biased ratchet arm 202 includes a plurality of teeth 216 extending outwardly from top side 208 proximate first end 204. Teeth 216 have a substantially similar shape as teeth 54 of second half bracelet 14 with a tooth short side 215 and a tooth long side 217 that intersect at a point, and wherein the tooth short side 215 is substantially orthogonal to top side 208. Long side 217 is sloped in a direction substantially parallel to long side 55 of teeth 54 when they are positioned one above the other.

Spring-biased ratchet arm 202 includes a notch 218 on bottom side 210 proximate first end 204. Notch 218 helps define a lock leg 220 at first end 204 of spring-biased ratchet arm 202. Spring-biased ratchet arm 202 is pivotally secured within base 36 by pin 222. Spring-biased ratchet arm may rotate around pin 222 and as shown in FIG. 5, rotation of spring-biased ratchet arm 202 may be restrained in one direction by spring 214 engaging spring leg 212.

As shown in FIG. 5, lock assembly 200 further includes a slide bar 224 having a first end 226, a second end 228, a top side 230, and a bottom side 232. First end 226 of slide bar 224 includes a first fork leg 234 having a free end 235 with a first fork outward protrusion 236 extending away from and substantially orthogonal from first fork leg 234 at free end 235. First end 226 of slide bar 224 also includes a second fork leg 238 having a free end 239 with second fork outward protrusion 240 extending away from and substantially orthogonal from second fork leg 238 at free end 239. First fork leg 234 and second fork leg 238 define a guide channel 242 in slide bar 224 wherein guide channel 242 engages a guide member 246 of a third spacing member 244 wherein guide member 246 may limit slide bar 224 to a substantially linear motion. Third spacing member 244 has a shape substantially similar to that of second spacing member 126 wherein a top side 245 of third spacing member 244 is recessed with respect to first plate member 24 and second plate member 26.

As further shown in FIG. 5, slide bar 224 also includes a socket 248 cut-out of bottom side 232 between first end 226 and second end 228. Lock assembly 200 also includes a channel spring 250 positioned between an end of guide member 244 and slide bar 224 between first and second fork legs 234 and 238. Channel spring 250 may be a compression spring disposed to resist movement of slide bar 224 in a linear direction. Other spring types may also be configured to provide substantially similar resistance. Further, a second fork leg spring 252 is disposed within a fork travel channel 254 to resist movement of slide bar 224 in a linear direction opposite the resistance of channel spring 250. Both springs 250 and 252 are disposed in lock assembly 200 to position slide bar 224 in a neutral position when the handcuff is in the locked mode of operation.

FIG. 5 shows lock assembly 200 including a lock wheel 256 within housing 78, wherein lock wheel 256 includes a key cavity 258 configured to receive and allow rotation of a key therein. Key cavity 258 is partially defined by a first key engagement surface 260 and a second key engagement surface 262 wherein first key engagement surface 260 and second key engagement surface 262 are on opposite sides of a center of lock wheel 256. Lock wheel 256 has an outer surface 264 which may engage and slide relative to housing 78. Lock wheel 256 includes a first lock wheel protrusion 266 extending outwardly from outer surface 264. Lock wheel 256 includes a second lock wheel protrusion 268 extending outwardly from outer surface 264.

First and second lock wheel protrusions 266 and 268 may have a "v" shape as shown or, alternatively, may be semi-circular, semi-oval, square, or trapezoidal. In the embodiment of FIG. 5, each lock wheel protrusion 266 and 268 may include two planar intersecting sides 270*a* and 270*b*, and 270*c* and 270*d* respectively. FIG. 5 also shows lock wheel 256 having a transfer arm 272 extending radially outward from outer surface 264. Transfer arm 272 may include a shaft 274 and knob 276 at the end of shaft 274. Knob 276 is configured to be received into socket 248 of slide bar 224. In the embodiment shown in FIG. 5, if transfer arm 272 is at a "twelve-o-clock" position, then first lock wheel protrusion 266 is located around "nine-o-clock" and second lock wheel protrusion 268 is located around "two-o-clock" to "three-o-clock."

As shown in FIG. 5, lock assembly 200 may also include a key rod 278 that is coupled to second plate member 26 and extends toward first plate member 24 within housing 78 through key cavity 258. As shown in FIG. 2, first plate member 24 or second plate member 26 includes a key hole 132 aligned with key rod 278 such that when a key is inserted through key hole 132, a hollow end of the key receives key rod 278 wherein key rod 278 operates as a guide axis for the rotation of the key.

As shown in FIG. 1, when handcuff 10 is assembled and first plate member 24 and second plate member 26 sandwich first spacing member 76, second spacing member 126 and third spacing member 244 to form base 36, first plate member 24 and second plate member 26 enclose housing 78 and locking mechanism 16. Moreover, the recessed top sides 129 and 245 of second and third spacing members 126 and 244 form a pass-through channel 134 for second half bracelet 14 to be able to rotate three-hundred sixty (360) degrees about first pin 58.

In use, handcuff 10 and locking mechanism 16 may operate in one of three modes: an active mode, a locked mode, and a release mode. As shown in FIG. 1, first side 24 of first half bracelet 12 may include a status or mode indicator window 136 that provides a visual indication of the current operational mode of handcuff 10. For example, portions of slide bar 224 may be painted a certain color such that the colored portion is below the indicator window 136 for each mode. For example, the active mode may be designated by a green indicator, the locked mode may be designated by a red indicator, and the release mode may be designated by a yellow color. However, a person of skill in the art will recognize there are many methods of indicating operational status of machines, such as handcuff 10, to the users.

Figure 6A:
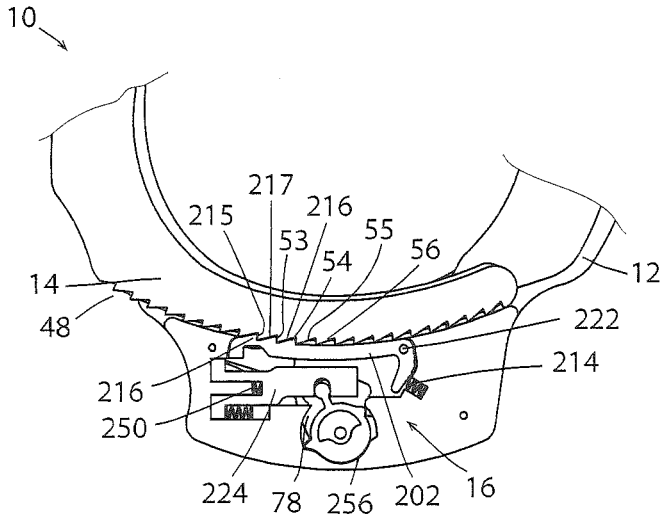
FIG. 6A is a front view of the locking mechanism of the handcuff of FIG. 1 in an active mode.
Figure 6B:
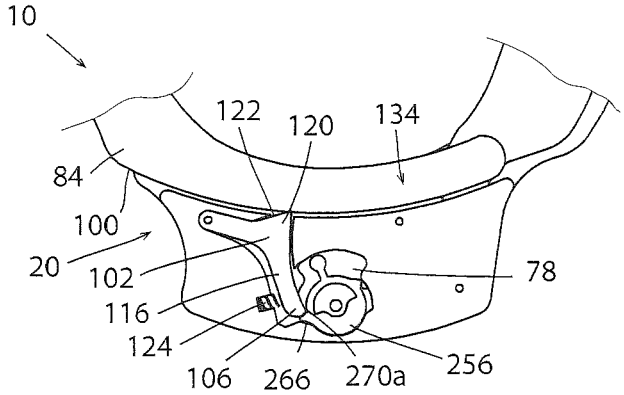
FIG. 6B is a front view of the second compression control mechanism of the handcuff of FIG. 1 in an active mode.
Figure 6C:
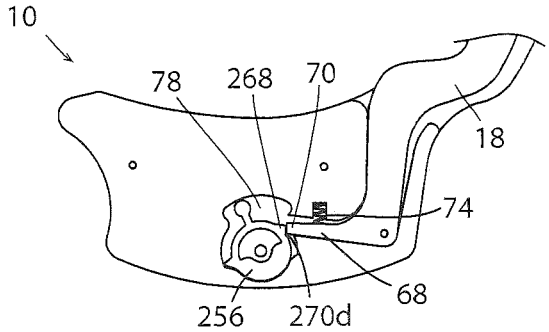
FIG. 6C is a front view of the first compression control mechanism of the handcuff of FIG. 1 in an active mode.

FIGS. 6A-C illustrate locking mechanism 16 in an active mode. Active mode is the operational mode in which users may freely apply the handcuffs to the intended target and first half bracelet and second half bracelet may only be moved relatively to constrict around an object, such as an arm or wrist. As shown in FIG. 6A, slide bar 224 is in a far left position resulting from lock wheel 256 being rotated by a key and held in a left-leaning position. Slide bar 224 engages channel spring 250 and is held in place by lock wheel 256. Second half bracelet 14 is positioned in pass-through channel 134. In this position, spring-biased ratchet arm 202 is free to displace downward and rotate about pin 222 such that the toothed portion 56 of outer face 48 of second half bracelet 14 can slide over teeth 216 of spring-biased ratchet arm 202. Spring 214 provides light resistance to the downward displacement and returns spring-biased ratchet arm 202 to its neutral position. Accordingly, immediately after long side 55 of tooth 54 slides over long side 217 of tooth 216, spring-biased ratchet arm 202 returns to a neutral position and tooth short side 53 will engage tooth short side 215 thereby preventing second half bracelet 14 from moving outwardly. Thus, in the active mode, second half bracelet 14 may only be displaced in a constricting direction. This is desirable as it prevents the person being handcuffed from sliding off handcuff 10 once the teeth 54 of second half bracelet 14 engage teeth 216 of spring-biased ratchet arm 202 and only allows the first and second half bracelets 12 and 14 to be displaced in a constricting direction.

FIG. 6B shows the position of second compression control mechanism 20 while handcuff 10 and locking mechanism 16 is in the active mode. Lever 84 of second compression control mechanism 20 is positioned within pass-through channel 134. Spring 124 is engaging second leg 116 of release lever 102 such that second end 106 of release lever 116 engages a planar side 270*a* of first protrusion 266 of lock wheel 256 thereby preventing clockwise rotation of lock wheel 256 within housing 78. Planar side 270*a* is orientated in an upward direction. Thus, as long as second end 106 engages protrusion 266 of wheel lock 256, slide bar 224 will remain in its left-most position. Protrusion 120 extends into pass-through channel 134 wherein outer surface 100 of lever 84 may rest upon protrusion 120 as lever 84 is moved relative to first half bracelet 12 in a constricting direction.

FIG. 6C shows the position of first compression control lever (mechanism) 18 while handcuff 10 and locking mechanism 16 are in the active mode. Spring 74 engages lock release leg 68 to push it downward to a neutral position. In the neutral position, object engagement portion 65 of first compression control lever 18 projects inward relative to first half bracelet 12. Release end 70 of lock release leg 68 engages planar side 270*d* of second protrusion 268 to prevent wheel lock 256 from rotating clockwise within housing 78. Thus, both first compression control lever 18 and second compression control mechanism 20 independently prevent lock wheel 256 from rotating clockwise within housing 78 thereby keeping slide bar 224 in its far-left position when handcuff 10 is in the active mode.

Figure 7A:
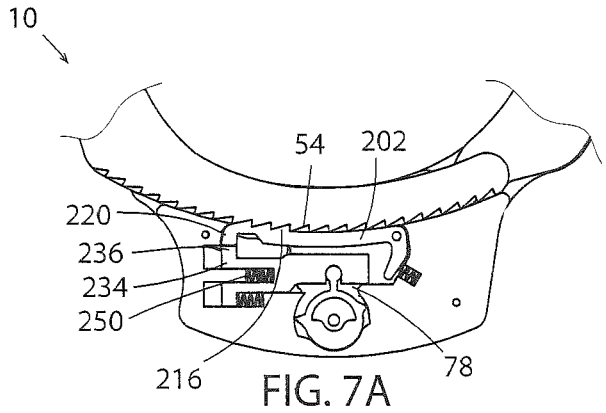
FIG. 7A is a front view of the locking mechanism of the handcuff of FIG. 1 in a locked mode.
Figure 7B:
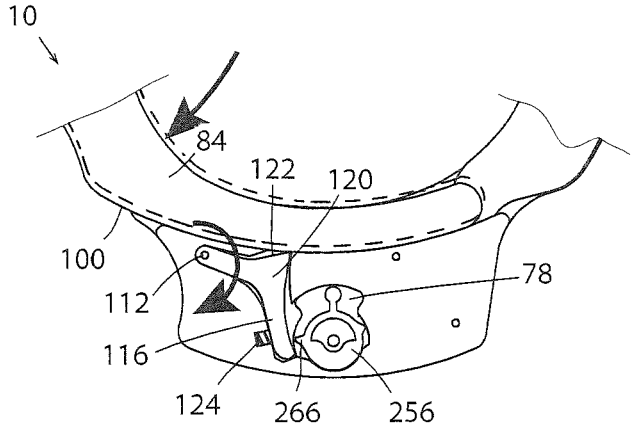
FIG. 7B is a front view of the second compression control mechanism of the handcuff of FIG. 1 in an locked mode.
Figure 7C:
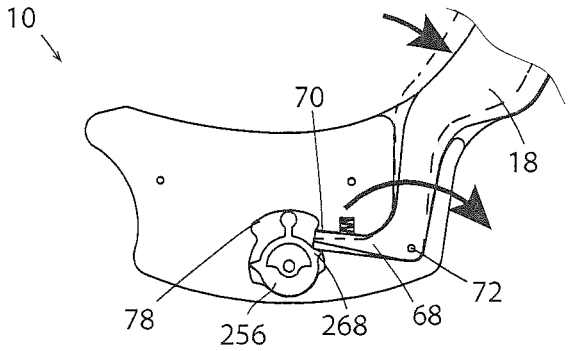
FIG. 7C is a front view of the first compression control mechanism of the handcuff of FIG. 1 in an locked mode.

FIGS. 7A-C illustrate handcuff 10 and locking mechanism 16 in a locked mode. Locked mode is the operational mode in which first half bracelet 12 and second half bracelet 14 cannot be moved in any relative direction. This operational mode prevents the handcuff 10 from being both removed from a target's arm and over-constricted upon a target's arms or legs. FIG. 7A illustrates locking mechanism 16 in the locked mode. The relative position of the elements in locked mode occurs just after triggering of both first compression control lever 18 and second compression control mechanism 20. Spring-biased ratchet arm 202 is in its neutral position similar to the position in FIG. 6A. Upon release of both the first compression control lever 18 and second compression control mechanism 20, channel spring 250 has propelled slide bar 224 into its neutral position. As shown in FIG. 7A, outward facing projection 236 of first fork leg 234 of slide bar 224 is positioned directly underneath lock leg 220 of spring-biased ratchet arm 202 such that at least a portion of outward facing projection 236 of first fork leg 234 prevents downward displacement of spring-biased ratchet arm 202. This position prevents the downward displacement of spring-biased ratchet arm 202 required for teeth 54 of second half bracelet 14 to slide over teeth 216 of spring-biased ratchet arm 202. Thus, by preventing spring-biased ratchet arm 202 from displacing downward, it simultaneously prevents handcuff 10 from both further constricting and releasing.

FIG. 7B illustrates second compression control mechanism 20 when handcuff 10 is in locked mode. For locking mechanism 16 to get from active mode to locked mode, second compression control mechanism 20 must be triggered thereby releasing wheel lock 256 for clockwise rotation due to the force of spring 250 on slide bar 224. As first half bracelet 12 and second half bracelet 14 are constricted around an object, FIG. 7B illustrates lever 84 of second compression control mechanism 20 being displaced outwardly (in the direction of the arrow) from its original position shown in dotted lines. Thus, outer surface 100 of lever 84 bears against angled linear portion 122 of protrusion 120 of release lever 102 causing release lever 102 to rotate about pin 112 in a clockwise direction (shown by the curved arrow) thereby compressing spring 124 and resulting in outward displacement of second end 106 of second leg 116. The outward displacement of second end 106 of second leg 116 frees protrusion 266 of lock wheel 256 so that lock wheel 256 may rotate clockwise within housing 78 when transfer arm 272 of lock wheel 256 is acted upon by slide bar 224.

FIG. 7C illustrates first compression control mechanism when handcuff 10 is in locked mode. For locking mechanism 16 to get from active mode to locked mode, first compression lever 18 must be triggered thereby releasing wheel lock 256 for clockwise rotation. As first half bracelet 12 and second half bracelet 14 are constricted around an object, FIG. 7C illustrates first compression lever 18 being displaced outwardly (in the direction of the arrow) from its original position shown in the dotted lines. The outward displacement causes a clockwise rotation of compression lever 18 about pin 72 which causes a vertical displacement of release end 70 of lock release leg 68. The rotational displacement of lock release leg 68 engages and constricts spring 74. The vertical displacement of release end 70 releases second protrusion 268 of wheel lock 256 and allows wheel lock 256 to rotate clockwise within housing 78 to a neutral position.

First compression control lever 18 and second compression control mechanism 20 remain activated as long as handcuff 10 is constricted tightly about an object (such as an arm or wrist). The combination of first compression control lever 18 and second compression control mechanism 20 results in automatically preventing handcuff 10 from being further constricted once both compression control mechanisms are triggered. Handcuff 10 of the present invention, therefore cannot be over-tightened causing injury or other liability.

Figure 8A:
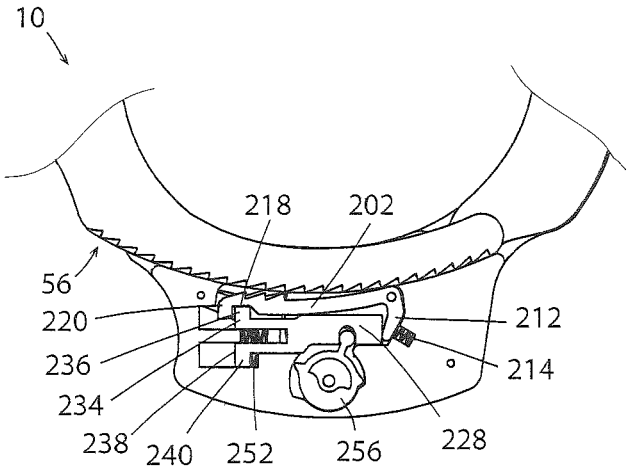
FIG. 8A is a front view of the locking mechanism of the handcuff of FIG. 1 in a release mode.
Figure 8B:
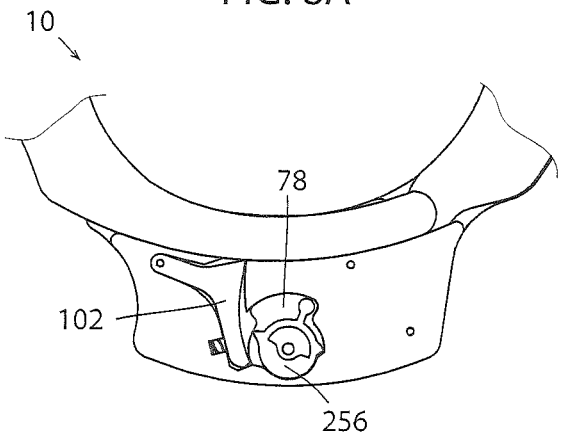
FIG. 8B is a front view of the second compression control mechanism of the handcuff of FIG. 1 in a release mode.
Figure 8C:
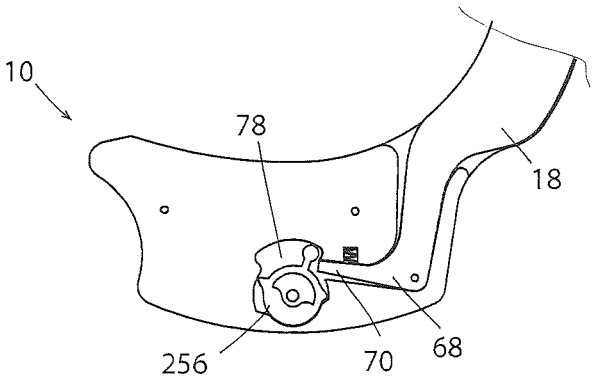
FIG. 8C is a front view of the first compression control mechanism of the handcuff of FIG. 1 in a release mode.

FIGS. 8A-C illustrate handcuff 10 and locking mechanism 16 in the release mode. Release mode is the operational mode in which second half bracelet 14 is free to move relative to first half bracelet 12 in any direction. This operational mode allows handcuff 10 to be removed from the object such as a target's arms or legs.

As shown in FIG. 8A, the release mode includes spring-biased ratchet arm 202 being displaced downward so that it no longer engages the toothed portion 56 of outer face 48 of second half bracelet 14. Locking wheel 256 rotates within housing 78 resulting from the user applying a torque with a key in a clockwise direction such that second end 228 of slide bar 224 bears against and displaces spring leg 212 of spring-biased ratchet arm 202 to the right causing compression of spring 214. Outward facing protrusion 236 of first fork leg 234 of slide bar 224 slides to the right so that it is under notch 218 in bottom side 210 of spring-biased ratchet arm 202. The lateral movement of slide bar 224 results in outward facing protrusion 240 of second fork leg 238 engaging second fork spring 252 as shown. The displacement of slide bar 224 and spring leg 212 to the right results in first end 204 of spring-biased ratchet arm 202 being displaced downward. When an operator ceases applying clockwise torque to the key, second fork spring 252 causes slide bar to displace to the left before lock leg 220 of spring-biased ratchet arm 202 is displaced upward, thereby creating a frictional engagement of spring-biased ratchet arm 202 and slide bar 224 holding spring-biased ratchet arm 202 in a downward position as shown. In this release mode, moveable second half bracelet 14 can be moved in an outward direction to separate from base 36 and spring-biased ratchet arm 202 in order to remove handcuff 10 from the object being constricted.

A user may return spring-biased ratchet arm 202 to a neutral position by removing the frictional engagement between spring-biased ratchet arm 202 and slide bar 224. A user may turn the key fully in the clockwise direction and, while still applying pressure on the key, slowly allow slide bar 224 to return to the neutral position. The slower displacement of slide bar 224 allows spring 214 to return spring-biased ratchet arm 202 to its neutral position before it is frictionally engaged by first fork 234 of slide bar 224.

FIG. 8B illustrates that release lever 102 being disengaged from wheel lock 256 in release mode allowing wheel lock 256 to freely rotate within housing 78. Similar, FIG. 8C illustrates that lock release leg 68 of first compression control lever 18 being disengaged from wheel lock 256 in release mode allowing wheel lock 256 to freely rotate within housing 78.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

What is claimed is:

1. A handcuff comprising:

a first half bracelet having a first end, a second end, and a curved shape, said second end including a base;

a second half bracelet having a first end, a second end, and a curved shape, said first end of said second half bracelet pivotally coupled to said first end of said first half bracelet wherein said first and said second half bracelets are curved outwardly to form an enclosed area;

a first compression control mechanism comprising a first lever pivotally coupled to said first half bracelet;

a second compression control mechanism comprising a second lever pivotally coupled to said second half bracelet; and a locking mechanism disposed within a housing of said base and operable to engage a toothed portion of said second half bracelet, said locking mechanism having a locked mode that prevents relative movement of said first half bracelet and said second half bracelet in a constriction direction upon said first compression control mechanism being triggered by a displacement of said first lever relative to said first half bracelet and said second compression control mechanism being triggered by a displacement of said second lever relative to said second half bracelet.

2. The handcuff of claim 1 wherein said first compression control mechanism further comprises said first lever having a first end, a second end, and an object engagement portion disposed between said first and second ends, and wherein said first lever is pivotally connected to said base and said object engagement portion projects inward into said enclosed area relative to said first half bracelet, and wherein said first compression control mechanism is triggered by an outward displacement of said object engagement portion causing said second end of said first lever to displace thereby releasing said locking mechanism into a locked mode upon said second compression control mechanism also being triggered.

3. The handcuff of claim 1 wherein said second compression control mechanism further comprises said a second lever pivotally coupled to said second half bracelet and a release lever pivotally disposed in said base and in operable engagement with said second lever, wherein said second lever projects inward into said enclosed area relative to said second half bracelet, and wherein said second compression control mechanism is triggered by said second lever being is displaced outwardly to engage said release lever, thereby resulting in an outward displacement of a leg of said release lever which releases said locking mechanism into a locked mode upon said first compression control mechanism also being triggered.

4. The handcuff of claim 1 wherein said locking mechanism comprises a spring-biased ratchet arm pivotally coupled within said base, a slide bar disposed within said base under said spring-biased ratchet arm and supported for linear lateral displacement within said base, and a locking wheel disposed within said housing of said base, said locking wheel having a transfer arm operably connected to said slide bar and said locking wheel being operable to engage said first and said second compression control mechanisms, wherein said spring-biased ratchet arm includes one or more teeth to engage one or more teeth of a toothed portion of said second half bracelet and wherein in said locked mode, a protrusion of said slide bar engages said spring-biased ratchet arm to prevent pivotal displacement of said spring-biased ratchet arm in a downward direction.

5. A handcuff comprising:

a first half bracelet having a first end, a second end, and a curved shape, said second end including a base, said first half bracelet further comprising a first side plate and a second side plate with a space therebetween;

a second half bracelet having a first end, a second end, and a curved shape, said first end of said second half bracelet pivotally coupled to said first end of said first half bracelet to form an enclosed area, said second half bracelet pinned for rotation in a plane parallel to and between said first and second side plates of said first half bracelet;

a first compression control mechanism, said first compression control mechanism comprises a first lever having a first end, a second end, and an object engagement portion disposed between said first and second ends, and wherein said lever is pivotally connected to said base and said object engagement portion is positioned between said first side plate and said second side plate of said first half bracelet and projects inward into said enclosed area relative to said first half bracelet;

a second compression control mechanism, wherein said second compression control mechanism comprises a second lever pivotally coupled to said second half bracelet and a release lever pivotally mounted within said base, wherein said second lever projects inward into said enclosed area relative to said second half bracelet, and wherein said release lever includes a middle protrusion disposed to engage said second lever; and a locking mechanism disposed within a housing defined in said base, said locking mechanism including a spring-biased ratchet arm pivotally coupled within said base, a slide bar disposed within said base underneath said spring-biased ratchet arm, said slide bar guided for linear displacement in a lateral direction within said base, and a lock wheel disposed within said housing of said base, said lock wheel having a transfer arm projecting outwardly therefrom and being operably engaged with said slide bar, and said lock wheel being disposed to allow engagement with said first and said second compression control mechanisms;

said spring-biased ratchet arm includes one or more teeth to engage one or more teeth of a toothed portion of said second half bracelet.

6. The handcuff of claim 5 wherein said locking mechanism is operational in an active mode, a locked mode, and a release mode.

7. The handcuff of claim 6 wherein said locking mechanism in said locked mode prevents relative movement of said first half bracelet and said second half bracelet in a constriction direction in response to a sufficient outward displacement of both said first compression control mechanism and said second compression control mechanism.

* * * * *